United States Patent [19]

Duffy

[11] 3,991,776

[45] Nov. 16, 1976

[54] EJECTOR TOOTHBRUSH

[76] Inventor: Lawrence Edward Duffy, 2127 W. Chateau Ave., Anaheim, Calif. 92804

[22] Filed: Dec. 8, 1975

[21] Appl. No.: 638,592

[52] U.S. Cl. ..... 132/84 R
[51] Int. Cl.[2] ..... A45D 44/18
[58] Field of Search ..... 132/84 R, 84 A–84 D

[56] References Cited

UNITED STATES PATENTS 2,620,500 12/1952 Ridner, Sr. ..... 132/84 R 2,765,799 10/1956 Ritter ..... 132/84 R

*Primary Examiner*—G.E. McNeill
*Attorney, Agent, or Firm*—Edward E. Roberts; Philip A. Dalton, Jr.

[57] ABSTRACT

A toothbrush comprising a handle unit and a detachable brush. The handle contains a manually controlled, spring latching mechanism for retaining and ejecting the brush. The handle also contains a detachable storage section for capsules or other forms of toothpaste, toothpowder, etc.

4 Claims, 2 Drawing Figures

EJECTOR TOOTHBRUSH

BACKGROUND OF THE INVENTION

1. Field of the Invention

This invention relates to toothbrushes and, more particularly, to toothbrush assemblies having detachable brushes.

2. Description of the Prior Art

Toothbrushes having detachable brushes are known in the art. Typically, quick release toothbrushes utilize a pressure fit to hold the brush in place. See, e.g., U.S. Pat. Nos. 993,629 to Witman; 1,642,620 to Merrill; and 2,601,244 to Boulicault. As will be appreciated, it is desirable to have a quick release toothbrush that is simple and inexpensive, yet utilizes means for retaining the brush that is not subject to wearing out due to repeated frictional engagement.

SUMMARY OF THE INVENTION

The present invention utilizes a toothbrush unit which is inserted into a handle and retained in the handle against a compressed spring by a manually-controlled detent. Disengaging the detent permits the spring to eject the brush unit. The handle includes a compartment for storing refill toothpaste or toothpowder capsules or the like.

DETAILS OF A PREFERRED EMBODIMENT

Figures 1, 2:
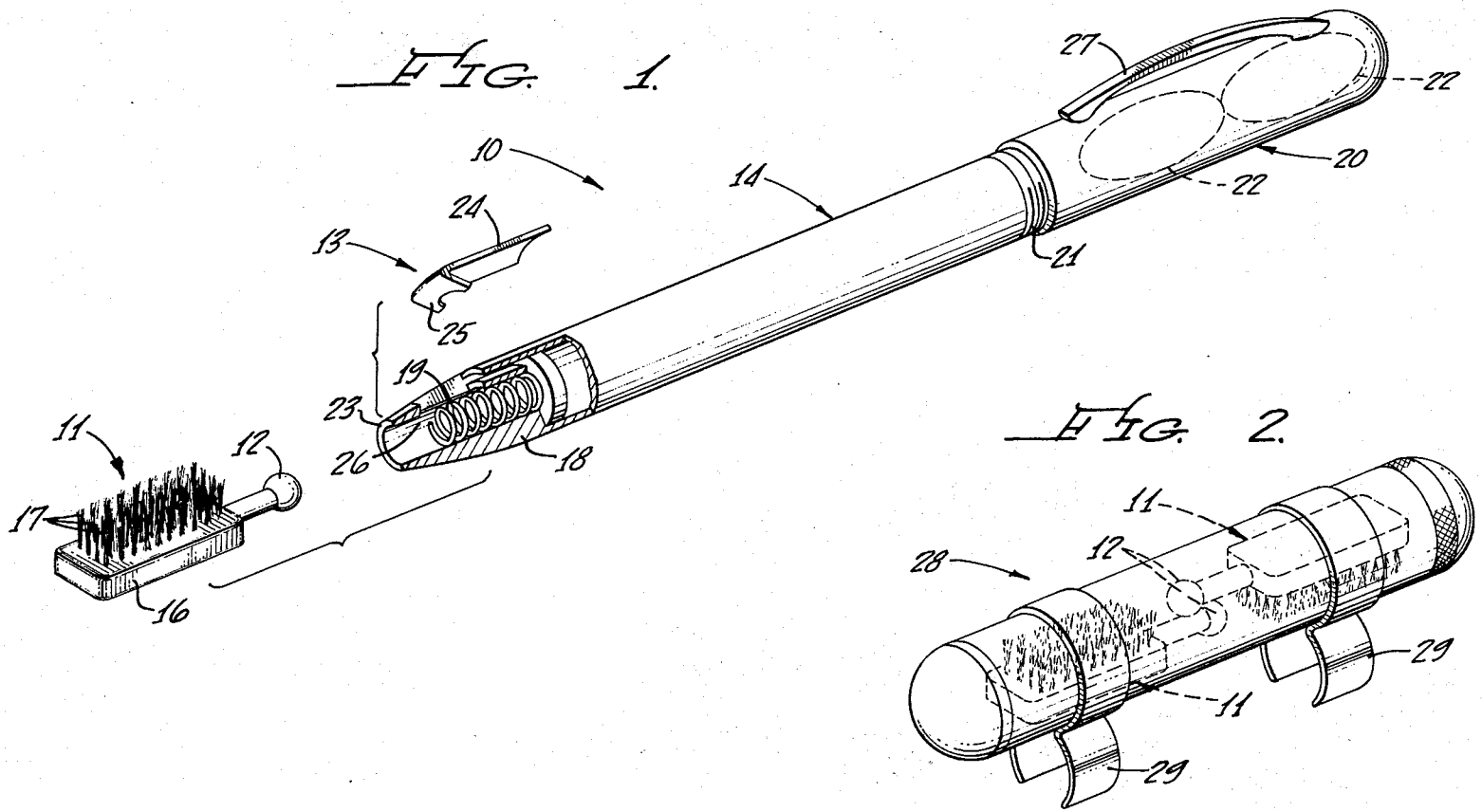
FIG. 1 is a perspective view, partially cut away with the elements being disengaged for clarity, of an ejector toothbrush assembly embodying principles of the present invention.
FIG. 2 is a perspective view of a brush holder that can be carried by the assembly of FIG. 1.

FIG. 1 shows an ejector toothbrush assembly 10 embodying principles of a preferred embodiment of the present invention. The assembly 10 comprises a brush unit 11 having a projecting ball portion 12 which is releaseably engaged by a manually operated detent mechanism 13 of ejector handle unit 14. The brush unit 11 comprises a base 16, typically of plastic or other light, form-retaining, moisture impervious material to which are attached bristles 17—17, also typically of plastic. In the embodiment shown, the ball 12 is integral with the base 16, although obviously the ball could be attached to the base and could be formed of different material.

The handle unit 14 comprises two portions: (1) a barrel 18 which mounts the detent mechanism 13 and a coil spring 19 and (2) a hollow head portion 20 which screws onto the barrel at a first end 21 thereof. The head 20 provides storage, for example, for capsules 22—22 of toothpaste, toothpowder, mouth freshener, etc. The barrel 18 receives the ball 12 at second end 23, opposite end 21. Detent mechanism 13, comprising leaf spring 24 and detent 25, is mounted on the barrel 18 near the second end 23 thereof. Normally, the leaf spring 24 biases the detent 25 into interior 26 of the barrel 18.

To releaseably attach the brush unit 11 to the handle 14, the ball 12 is inserted into the barrel 18 via end 23. In moving into the barrel 18, the ball 12 pivots the detent 25 away from the path of the advancing ball and engages and compresses the coil spring 19. As the ball moves past the detent 25, leaf spring 24 urges the detent back into the interior 26 of the barrel and retains the ball 12 and the brush unit 11 in place against the spring 19. When it is desired to remove the brush unit, the detent mechanism 13 is manually pivoted away from the ball 12 (upwardly as viewed in FIG. 1), to allow the compressed spring 19 to eject the brush unit 11 from the barrel.

As shown in FIG. 1, the head 20, (or the barrel 18) may have a clip 27 for attaching the assembly 10 to clothing, etc.

Referring now to FIG. 2, there is shown a holder 28 for several brushes 11—11 (shown by dotted lines). The holder 28 may be detachably secured to the handle unit 14 by clip(s) 29. Thus, the holder 28 and spare brushes may be carried by the toothbrush assembly 10 and easily removed from the assembly when the assembly is used.

There has been described an ejector toothbrush assembly featuring a detachable brush unit that is securely held by, but easily ejected from, a handle unit. In addition to its ease of operation, the assembly is very durable in not being susceptible to the problems which wear and resulting dimensional changes present for pressure or friction-fit assemblies. It will be appreciated that the scope of the invention is limited only by the claims appended hereto and equivalents thereof.

Having described a preferred embodiment of the invention, what is claimed is:

1. A toothbrush assembly, comprising:

handle means having first and second, opposite ends and a hollow interior portion;

brush means having an end of suitable dimensions for insertion via said first end into the interior of said handle means;

a spring latching mechanism mounted to said handle means and comprising (1) a spring within said interior portion for engaging and being compressed by said brush end upon insertion of said brush end into the interior portion of said handle and (2) a detent pivotally mounted on said handle for releaseably engaging said brush end opposite said compressed spring to retain said brush end against said spring.

2. The toothbrush assembly defined in claim 1, further comprising a container releaseably attached to the second end of said handle means.

3. The toothbrush assembly defined in claim 1, further comprising an elongated container for at least one of said brush means having at least a clip for releaseably fastening said elongated container in side-by-side relationship to said handle means.

4. A toothbrush assembly, comprising:

a handle comprising an elongated body having first and second ends, said first end being open, at least a hollow interior portion extending to said first open end and an opening near said first end communicating with said hollow portion;

a brush having a ball formed at one end for insertion via said first, open end into said hollow interior portion;

resilient biasing means within said hollow interior portion compressible parallel to the length of said body for being compressed by said ball upon insertion of said brush into said handle; and latching means comprising a leaf spring having a detent, said spring being affixed to said body such that the detent is normally biased by said spring into said hollow interior portion via said opening, said detent being (1) moved aside by said ball entering said hollow interior portion and (2) upon continued movement of said ball past the detent, returned by said spring to releaseably engage and retain said ball against said resilient biasing means.

* * * * *